US005454969A

United States Patent [19]

Fields et al.

[11] Patent Number: 5,454,969

[45] Date of Patent: Oct. 3, 1995

[54] CLEANING FLUIDS

[76] Inventors: Paul B. Fields, R.R. 2-Box 60A, Hudson, N.Y. 12534; Larry M. Fields, 6 Soulagnet Ct., Dix Hills, N.Y. 11746

[21] Appl. No.: 147,605

[22] Filed: Nov. 4, 1993

Related U.S. Application Data

[63] Continuation-in-part of Ser. No. 80,029, Jun. 18, 1993.

[51] Int. Cl.[6] ..... C11D 7/50; C23G 5/028

[52] U.S. Cl. ..... 252/162; 252/164; 252/170

[58] Field of Search ..... 252/162, 164, 252/170, 171, 364, 8.9; 8/149.1

[56] References Cited

U.S. PATENT DOCUMENTS

| | | | |
|---|---|---|---|
| 2,346,622 | 4/1944 | Steck . | |
| 2,866,726 | 12/1958 | Vance . | |
| 2,947,792 | 8/1960 | Skeeters . | |
| 3,254,029 | 5/1966 | Piepmeyer et al. . | |
| 3,356,498 | 12/1967 | Moe et al. . | |
| 3,356,499 | 12/1967 | Moe et al. . | |
| 3,357,828 | 12/1967 | Moe et al. . | |
| 3,357,829 | 12/1967 | Moe et al. . | |
| 3,915,902 | 10/1975 | Ancel et al. . | |
| 3,925,010 | 12/1975 | Barton . | |
| 4,242,218 | 12/1980 | Vander Mey . | |
| 4,859,359 | 8/1989 | DeMatteo et al. . | |
| 4,877,556 | 10/1989 | Wilsberg et al. . | |
| 5,059,728 | 10/1991 | Li et al. . | |
| 5,104,564 | 4/1992 | Lermond et al. | 252/170 |
| 5,124,063 | 6/1992 | Logsdon et al. . | |
| 5,124,064 | 6/1992 | Logsdon et al. | 252/171 |
| 5,145,523 | 9/1992 | Haldpin et al. | 106/287.24 |
| 5,190,679 | 3/1993 | McDonald . | |
| 5,225,099 | 7/1993 | Basu et al. . | |

FOREIGN PATENT DOCUMENTS

| | | |
|---|---|---|
| 1-132814 | 5/1989 | Japan . |
| 1-141995 | 6/1989 | Japan . |
| 1-141996 | 6/1989 | Japan . |
| 1-141997 | 6/1989 | Japan . |
| 2-214800 | 8/1990 | Japan . |

*Primary Examiner*—Arthur C. Prescott
*Attorney, Agent, or Firm*—Jordan and Hamburg

[57] ABSTRACT

A cleaning fluid for fabrics includes one or more hydrochlorofluorocarbons and/or hydrofluorocarbons, one or more alcohols and/or glycol ethers, and one or more paraffinic hydrocarbons.

35 Claims, No Drawings

CLEANING FLUIDS

CROSS-REFERENCE TO RELATED APPLICATIONS

This application is a continuation-in-part of application Ser. No. 08/080,029, filed Jun 18, 1993.

BACKGROUND OF THE INVENTION

The present invention relates to cleaning fluids for fabrics. The invention is suitable for use by apparel manufacturers, textile mills, retailers of apparel, textile screen printers, upholsterers, household consumers and anyone else who deals with textiles.

For many years, the most commonly used chemical in fabric spot removers was 1,1,1-trichloroethane. Spot removers typically contained either 100% 1,1,1-trichloroethane or were composed of large percentages of 1,1,1-trichloroethane.

1,1,1-trichloroethane is fast drying and effective on most "dry side" stains (such as oil, grease and dirt). Unfortunately, the Environmental Protection Agency (E.P.A.) has determined 1,1,1-trichloroethane is a "Class 1" ozone depleting substance.

To protect the environment, the E.P.A. has placed a progressive tax on 1,1,1-trichloroethane and has created a phase out schedule for 1,1,1-trichloroethane. As of May 15, 1993, any product containing 1,1,1-trichloroethane or any product manufactured using 1,1,1-trichloroethane must bear an ozone depleting warning. This warning must be posted on all products treated with 1,1,1-trichloroethane and includes, for example, garments which have been spot cleaned using 1,1,1-trichloroethane.

There has been a great deal of effort within the industry to produce a replacement for 1,1,1-trichloroethane. Unfortunately, the available cleaning solvents are either more toxic (such as, for example, trichloroethylene, methylene chloride and perchloroethylene), highly flammable (such as, for example, petroleum distillates, alcohols, etc.) or are slow drying (such as, for example, mineral spirits). Accordingly, there is a strong need and a tremendous market for a "drop in" replacement which is less damaging to the ozone, does not pose a flammability hazard and is quick drying.

U.S. Pat. No. 3,254,029 to Piepmeyer discloses a dry cleaning detergent composition prepared by condensing a higher fatty acid with an alkanolamine. The condensate, and an excess of the alkanolamine, is then reacted at elevated temperatures with an acidic, surface-active agent. Piepmeyer does not describe or suggest a fabric cleaner having one or more hydrochlorofluorocarbons and/or hydrofluorocarbons.

U.S. Pat. No. 3,925,010 to Barton discloses azeotropic mixtures of chlorodifluoroethane with amyl alcohol and water. Barton further states that the mixture of lower aliphatic alcohols and halogenated hydrocarbons for use in dry cleaning is known and that such combinations tend to be flammable and constitute a serious fire hazard. Barton does not disclose a dry cleaning solution having one or more hydrochlorofluorocarbons and/or hydrofluorocarbons in combination with one or more alcohols and one or more paraffinic hydrocarbons.

U.S. Pat. No. 2,346,622 to Steck discloses a cleaning composition having a chlorinated hydrocarbon, alcohol and paraffin wax. Steck et al do not disclose or suggest a cleaning agent having one or more hydrochlorofluorocarbons and/or hydrofluorocarbons.

U.S. Pat. No. 5,145,523 to Halpin et al discloses a liquid cleaning solution for plastic and metallic surfaces. The cleaning solution of Halpin et al includes an isoparaffin solvent (such as, ISOPAR™ "G", "H", "K" and "L") and a 4 to 10 carbon monohydric alcohol. Halpin et al do not teach or suggest the inclusion of one or more hydrochlorofluorocarbons and/or hydrofluorocarbons in a cleaning solution to be used for the cleaning of textiles.

U.S. Pat. No. 5,124,063 to Logsdon et al discloses an azeotrope-like industrial cleaning solvent used to clean printed circuit boards which is also useful for dry cleaning. Logsdon et al '063 further discloses that solvent cleaning with fluorocarbon based solvents is widespread in the industry. The composition of Logsdon et al '063 includes a hydrochlorofluorocarbon, methanol and an alkane having five or six carbon atoms. The alkane can be an isoparaffin. The composition of Logsdon et al '063 preferably comprises from about 55 to about 97.8 wt. % of 1,1-dichloro-1-fluoroethane, from about 1 to about 38 wt. % of dichlorotrifluoroethane, from about 1 to about 4 wt. % of methanol and from about 0.5 to about 15 wt. % of an alkane having five of six carbon atoms which can be an isoparaffin. Logsdon et al '063 also refers to Kokai Patent Publication 139,861, which discloses a dry-cleaning agent having 67 wt. % 1,1-dichloro-2,2,2 trifluoroethane, 33 wt. % 1,1-dichloro-1-fluoroethane plus hydrocarbons, alcohols, ketones, chlorinated hydrocarbons and surfactants. The composition of the Logsdon et al '063 patent is directed toward the cleaning of printed circuit boards and the weight percentages of its components are materially different than those of the present invention. Thus, Logsdon et al '063 does not suggest or disclose the invention as described.

U.S. Pat. No. 5,124,064 to Logsdon et al discloses an azeotrope-like composition having a slightly different composition than that described in U.S. Pat. No. 5,124,063. The Logsdon et al '064 patent discloses a cleaning composition having from about 55 to about 98 wt. % of 1,1-dichloro-1-fluoroethane, from about 1 to about 38 wt. % of dichlorotrifluoroethane, from about 0.5 to about 3 wt. % of ethanol and from about 0.5 to about 10 wt. % of an alkane having five or six carbon atoms which can be an isoparaffin. Logsdon et al '064 does not suggest or disclose the invention as described. The composition of the Logsdon et al '064 patent is directed toward the cleaning of painted circuit boards and the weight percentages of its components are materially different than those of the present invention.

SUMMARY OF THE INVENTION

According to the invention, it has been found that a mixture of one or more hydrofluorocarbons and/or hydrochlorofluorocarbons, one or more alcohols and/or glycol ethers and one or more paraffinic hydrocarbons is a highly effective cleaning fluid for fabrics.

The cleaning fluid of the present invention is an excellent replacement for 1,1,1-trichloroethane. An advantage of the cleaning fluid of the present invention is that unlike other proposed substitutes for 1,1,1-trichloroethane, it has a flash point of over 100° F. The paraffinic hydrocarbon and isopropyl alcohol mixture has a flash point under 100° F. The addition of a hydrochlorofluorocarbon or hydrofluorocarbon elevates the flash point to over 100° F. and makes the product much safer to use than other cleaning fluids such as alcohol and petroleum distillates. Further, the addition of a glycol ether elevates the flash point to over 140° F. and thereby eliminates the need for a "flammable liquid" warning label.

Still another advantage of the cleaning fluid of the present invention is that it is quick drying and easy to use.

Another advantage of the cleaning fluid of the present invention is that it has a lower toxicity level than 1,1,1-trichloroethane. The cleaning fluid of the present invention has a threshold limit value (T.L.V.) of 400 ppm, when using isopropyl alcohol, as opposed to a T.L.V. of 350 ppm for 1,1,1-trichloroethane. The cleaning fluid of the present invention is also much less toxic than other available cleaning solvents (such as, for example, tricholoroethylene, methylene chloride and perchloroethylene).

A still further advantage of the present invention is that the inclusion of a hydrofluorocarbon or a hydrochlorofluorocarbon does not trigger a requirement for an ozone depletion warning. Yet another advantage of the present invention is that hydrofluorocarbons have absolutely no ozone depleting effects.

The cleaning fluid of the present invention is particularly useful as a spot remover for fabrics. The cleaning fluid is generally applied to the stain with a cloth or through a high pressure spotting gun, although other processes of application may be contemplated by one with ordinary skill in the art.

DETAILED DESCRIPTION OF THE INVENTION

The cleaning fluid of the present invention preferably includes from about 5 to about 50 wt % of one or more hydrochlorofluorocarbons and/or hydrofluorocarbons, from about 0 to about 30 wt % of one or more alcohols and/or glycol ethers and from about 25 to about 75 wt % of one or more paraffinic hydrocarbons.

Suitable paraffinic hydrocarbons include:

ISOPAR E—isoparaffin mixture with a range of from C8 to C10

ISOPAR G—isoparaffin mixture with a range of from C10 to C14

Other suitable paraffinic hydrocarbons include, for example, a mixture of C5 to C13 isoparaffins, a mixture of C5 to C13 cycloparaffins and a mixture of C6 to C13 normal paraffins, or mixtures thereof. Preferably, a mixture of C8 to C10 isoparaffins, a mixture of C6 to C9 isoparaffins, or a mixture of C9 to C13 isoparaffins is used.

Suitable alcohols include, for example, isopropyl alcohol, methyl alcohol, propyl alcohol, n-butyl alcohol, ethyl alcohol and isobutyl alcohol. Preferably, isopropyl alcohol, n-propyl alcohol and secondary butyl alcohol are used.

Suitable hydrofluorocarbons include, for example, "GENESOLV 3000", manufactured by Allied Signal, which has a boiling point of 150°–160° F., a liquid density of 1.5–1.6 g/cc, a solubility parameter of 7.6 cal/cc, a heat of vaporization of 65 Btu/lb, no flash point, a lifetime of about 10 to 30 years, and a threshold limit value (TLV) of 400 to 500 ppm. Additionally, "GENESOLV 3000" is a liquid HFC having low surface tension, low viscosity and zero ozone depletion.

Suitable hydrochlorofluorocarbons include, for example, dichlorofluoroethane, dichlorotrifluoroethane and dichloropentafluoropropane.

Suitable glycol ethers include monopropylene glycol monomethyl ether, dipropylene glycol monomethyl ether, tripropylene glycol monomethyl ether, propylene glycol monomethyl ether acetate, dipropylene glycol monomethyl ether acetate, propylene glycol t-butyl ether, ethylene glycol monomethyl ether, ethylene glycol monoethyl ether, and ethylene glycol monobutyl ether.

One of the most preferred embodiments of the present invention includes about 5 wt % to about 50 wt. % hydrofluorocarbon, from about 0 wt % to about 30 wt. % glycol ether and from about 25 wt % to about 75 wt % paraffinic hydrocarbons. Hydrofluorocarbons are ozone friendly and are completely non-ozone depleting.

It is also preferred to use 5 wt % to about 50 wt. % hydrofluorocarbon, from about 0 wt % to about 30 wt. % alcohol and from about 25 wt % to about 75 wt % paraffinic hydrocarbons.

A preferred embodiment of the present invention includes about 36 wt % of 1,1-dichloro-1-fluoroethane (known in the art as HCFC 141*b*), about 17 wt % monopropylene glycol monomethyl ether and about 47 wt % of a mixture of isoparaffins with a carbon atom range of C8 through C13.

Another preferred embodiment of the present invention includes about 36 wt % 1,1-dichloro-1-fluoroethane (HCFC 141*b*), about 9 wt % isopropyl alcohol and about 55 wt % paraffinic hydrocarbons.

Yet another preferred embodiment of the present invention includes about 36 wt % 1,1-dichloro-1-fluoroethane (HCFC 141*b*), about 9 wt % isopropyl alcohol and about 55 wt % of a mixture of C8 to C10 isoparaffins. The overall ozone depleting potential of this embodiment is approximately 20 to 25% less than that of straight 1,1,1-trichloroethane. Under the guidelines established by the E.P.A., this embodiment is not a "Class 1" ozone depleting substance and does not require an "ozone depletion warning" on materials cleaned with this cleaning fluid.

The following examples of cleaning fluids further illustrate the invention.

EXAMPLE 1

| | |
|---|---|
| dichlorofluoroethane (HCFC 14 lb) | 36% by weight |
| isopropyl alcohol | 9% by weight |
| paraffinic hydrocarbons | 55% by weight |
| the paraffinic hydrocarbons are a mixture of isoparaffins with a carbon atom range of C8 through C10 | |

EXAMPLE 2

| | |
|---|---|
| dichlorofluoroethane | 30% by weight |
| n-propyl alcohol | 13% by weight |
| isoparaffin (C8 to C10 mixture) | 57% by weight |

EXAMPLE 3

| | |
|---|---|
| dichlorofluoroethane | 40% by weight |
| secondary butyl alcohol | 15% by weight |
| isoparaffin (C8 to C10 mixture) | 45% by weight |

EXAMPLE 4

| | |
|---|---|
| "GENESOLV 3000" | 20% by weight |
| isopropyl alcohol | 10% by weight |
| paraffinic hydrocarbons | 70% by weight |

EXAMPLE 5

| | |
|---|---|
| dichlorofluoroethane | 36% by weight |
| monopropylene glycol monomethyl ether | 17% by weight |
| isoparaffin (C8 to C13 mixture) | 47% by weight |

Having now fully described the invention, it will be apparent to one of ordinary skill in the art that many changes and modifications can be made thereto without departing from the spirit or scope of the invention as set forth herein.

What we claim is:

1. A cleaning mixture comprising about 5 to about 45 wt. % of at least one hydrofluorocarbon and/or at least one hydrochlorofluorocarbon, up to 30 wt. % of at least one alcohol and/or at least one glycol ether and from about 25 to about 75 wt % of at least one paraffinic hydrocarbon.

2. A mixture according to claim 1 wherein said hydrochlorofluorocarbon is selected from the group consisting of dichlorofluoroethane, dichlorotrifluoroethane and dichloropentafluoropropane.

3. A mixture according to claim 1 wherein said alcohol is selected from the group consisting of isopropyl alcohol, methyl alcohol, propyl alcohol, n-butyl alcohol, n-propyl alcohol, isobutyl alcohol, ethyl alcohol and secondary butyl alcohol.

4. A mixture according to claim 1 wherein said paraffinic hydrocarbon is selected from the group consisting of C5 to C13 isoparaffinic hydrocarbons, C5 to C13 cycloparaffinic hydrocarbons, C6 to C13 normal paraffinic hydrocarbons, and mixtures of the above.

5. A mixture according to claim 1 wherein said glycol ether is selected from the group consisting of monopropylene glycol monomethyl ether, dipropylene glycol monomethyl ether, tripropylene glycol monomethyl ether, propylene glycol monomethyl ether acetate, dipropylene glycol monomethyl ether acetate, propylene glycol t-butyl ether, ethylene glycol monomethyl ether, ethylene glycol monoethyl ether, and ethylene glycol monobutyl ether.

6. A cleaning mixture according to claim 1 comprising a hydrofluorocarbon, an alcohol and a paraffinic hydrocarbon, wherein the mixture includes about 36 wt % of said hydrofiuorocarbon, said alcohol is isopropyl alcohol and said isopropyl alcohol comprises about 9 wt % of the mixture and said paraffinic hyrdrocarbon is a mixture of C8 to C10 isoparaffins and said isoparaffins comprise about 55 wt % of the mixture.

7. A cleaning mixture according to claim 1 comprising a hydrochlorofluorocarbon, a glycol ether and a paraffinic hydrocarbon, wherein said hydrochlorofluorocarbon is dichlorofluoroethane and said dichlorofluoroethane comprises 36 wt % of the mixture, said glycol ether is monopropylene glycol monomethyl ether and said monopropylene glycol monomethyl ether comprises about 17 wt % of the mixture and said paraffinic hydrocarbon is a mixture of C8 to C13 isoparaffins and said isoparaffins comprise about 47 wt % of the mixture.

8. A method of removal of a stain from a fabric comprising applying a cleaning mixture according to claim 1 to the stain.

9. A cleaning mixture according to claim 1, wherein the hydrofluorocarbon has a boiling point between 150° and 160° F., a liquid density of 1.5 to 1.6 g/cc, and a heat of vaporization of 65 Btu/lb.

10. A cleaning mixture according to claim 1, wherein a combination of the at least one alcohol and the at least one paraffinic hydrocarbon has a flash point of less than 100° F. and a combination of the at least one alcohol, the at least one paraffinic hydrocarbon and the at least one of a hydrofluorocarbon and a hydrochlorofluorocarbon has a flash point of greater than 100° F.

11. A cleaning mixture according to claim 10, wherein a combination of the at least one alcohol, the at least one paraffinic hydrocarbon, the at least one hydrofluorocarbon and/or the at least one hydrochlorofluorocarbon and the at least one glycol ether has a flash point of greater than 140° F.

12. A cleaning mixture comprising from about 5 to about 45 wt. % of at least one hydrofluorocarbon and/or at least one hydrochlorofluorocarbon, up to 30 wt. % of at least one alcohol and from about 25 to about 75 wt. % of at least one paraffinic hydrocarbon.

13. A cleaning mixture according to claim 12 wherein said hydrochlorofluorocarbon is selected from the group consisting of dichlorofluoroethane, dichlorotrifluoroethane and dichloropentafluoropropane.

14. A cleaning mixture according to claim 12, wherein said hydrofiuorocarbon has a boiling point between 150° and 160° F., a liquid density of 1.5 to 1.6 g/cc, and a heat of vaporization of 65 Btu/lb.

15. A cleaning mixture according to claim 12 wherein said alcohol is selected from the group consisting of isopropyl alcohol, methyl alcohol, n-butyl alcohol, n-propyl alcohol, isobutyl alcohol, ethyl alcohol and secondary butyl alcohol.

16. A cleaning mixture according to claim 12 wherein said paraffinic hydrocarbon is selected from the group consisting of C5 to C13 isoparaffinic hydrocarbons, C5 to C 13 cycloparaffinic hydrocarbons, C6 to C 13 normal paraffinic hydrocarbons, and mixtures of the above.

17. A cleaning mixture according to claim 12, wherein a combination of the at least one alcohol and the at least one paraffinic hydrocarbon has a flash point of less than 100° F. and a combination of the at least one alcohol, the at least one paraffinic hydrocarbon and the at least one of a hydrofluorocarbon and a hydrochlorofluorocarbon has a flash point of greater than 100° F.

18. A method of removal of a stain from a fabric comprising applying a cleaning mixture according to claim 12 to the stain.

19. A cleaning mixture comprising from about 5 to about 45 wt. % of at least one hydrochlorofluorocarbon, from about 5 to about 30 wt. % of at least one of a C1 to C4 monohydric alcohol and a glycol ether and from about 25 to about 75 wt. % of at least one C5 to C14 isoparaffin.

20. A cleaning mixture according to claim 19 wherein said hydrochlorofluorocarbon is selected from the group consisting of dichlorofluoroethane, dichlorotrifluoroethane and dichloropentafluoropropane.

21. A cleaning mixture according to claim 19 wherein said alcohol is selected from the group consisting of isopropyl alcohol, methyl alcohol, n-butyl alcohol, n-propyl alcohol, isobutyl alcohol, ethyl alcohol and secondary butyl alcohol.

22. A cleaning mixture according to claim 19 wherein said paraffinic hydrocarbon is selected from the group consisting of C5 to C13 isoparaffinic hydrocarbons, C5 to C13 cycloparaffinic hydrocarbons, C6 to C13 normal paraffinic hydrocarbons, and mixtures of the above.

23. A cleaning mixture according to claim 19 wherein said glycol ether is selected from the group consisting of monopropylene glycol monomethyl ether, dipropylene glycol monomethyl ether, tripropylene glycol monomethyl ether, propylene glycol monomethyl ether acetate, dipropylene glycol monomethyl ether acetate, propylene glycol t-butyl ether, ethylene glycol monomethyl ether, ethylene glycol monoethyl ether and ethylene glycol monobutyl ether.

24. A cleaning mixture according to claim 19, wherein a combination of the at least one alcohol and the at least one paraffinic hydrocarbon has a flash point of less than 100° F. and a combination of the at least one alcohol, the at least one paraffinic hydrocarbon and the at least one hydrochlorofluorocarbon has a flash point of greater than 100° F.

25. A cleaning mixture according to claim 24, wherein a combination of the at least one alcohol, the at least one paraffinic hydrocarbon, the at least one hydrochlorofluorocarbon and the at least one glycol ether has a flash point of greater than 140° F.

26. A method of removal of a stain from a fabric comprising applying a cleaning mixture according to claim 19 to the stain.

27. A cleaning mixture comprising from about 5 to about 45 wt. % of at least one hydrofluorocarbon, from about 5 to about 30 wt. % of at least one C1 to C4 monohydric alcohol and/or at least one glycol ether and from about 25 to about 75 wt. % of at least one C5 to C14 isoparaffin.

28. A cleaning mixture according to claim 27, wherein said hydrofluorocarbon has a boiling point between 150° and 160° F., a liquid density of 1.5 to 1.6 g/cc, and a heat of vaporization of 65 Btu/lb.

29. A cleaning mixture according to claim 27 wherein said alcohol is selected from the group consisting of isopropyl alcohol, methyl alcohol, n-butyl alcohol, n-propyl alcohol, isobutyl alcohol, ethyl alcohol and secondary butyl alcohol.

30. A cleaning mixture according to claim 27 wherein said paraffinic hydrocarbon is selected from the group consisting of C5 to C13 isoparaffinic hydrocarbons, C5 to C 13 cycloparaffinic hydrocarbons, C6 to C 13 normal paraffinic hydrocarbons, and mixtures of the above.

31. A cleaning mixture according to claim 27 wherein said glycol ether is selected from the group consisting of monopropylene glycol monomethyl ether, dipropylene glycol monomethyl ether, tripropylene glycol monomethyl ether, propylene glycol monomethyl ether acetate, dipropylene glycol monomethyl ether acetate, propylene glycol t-butyl ether, ethylene glycol monomethyl ether, ethylene glycol monoethyl ether and ethylene glycol monobutyl ether.

32. A cleaning mixture according to claim 27, wherein a combination of the at least one alcohol and the at least one paraffinic hydrocarbon has a flash point of less than 100° F. and a combination of the at least one alcohol, the at least one paraffinic hydrocarbon and the at least one hydrofluorocarbon has a flash point of greater than 100° F.

33. A cleaning mixture according to claim 32, wherein a combination of the at least one alcohol, the at least one paraffinic hydrocarbon, the at least one hydrofluorocarbon and the at least one glycol ether has a flash point of greater than 140° F.

34. A method of removal of a stain from a fabric comprising applying a cleaning mixture according to claim 27 to the stain.

35. A cleaning mixture comprising from about 5 to about 45 wt. % of at least one hydrochlorofluorocarbon, up to 30 wt. % of at least one alcohol and from about 25 to about 75 wt. % of at least one paraffinic hydrocarbon.

* * * * *